US011760604B1

(12) United States Patent
Tracey

(10) Patent No.: US 11,760,604 B1
(45) Date of Patent: Sep. 19, 2023

(54) VERSATILE ELEVATOR DOOR INTERLOCK ASSEMBLY

(71) Applicant: OTIS ELEVATOR COMPANY, Farmington, CT (US)

(72) Inventor: Michael J. Tracey, Cromwell, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 17/826,324

(22) Filed: May 27, 2022

(51) Int. Cl.
*B66B 13/12* (2006.01)

(52) U.S. Cl.
CPC ..... *B66B 13/12* (2013.01)

(58) Field of Classification Search
CPC ..... B66B 13/12
See application file for complete search history.

(56) References Cited

U.S. PATENT DOCUMENTS

| | | | |
|---|---|---|---|
| 1,950,150 | A | 3/1934 | Norton et al. |
| 3,315,767 | A | 4/1967 | Walter |
| 3,638,762 | A | 2/1972 | Johns |
| 4,094,385 | A | 6/1978 | Maeda et al. |
| 4,457,405 | A | 7/1984 | Johns |
| 4,923,055 | A | 5/1990 | Holland |
| 5,538,106 | A | 7/1996 | McHugh et al. |
| 5,651,427 | A | 7/1997 | Kulak et al. |
| 5,651,428 | A | 7/1997 | Ahigian et al. |
| 5,718,055 | A | 2/1998 | Pierce et al. |
| 5,732,796 | A | 3/1998 | Ahigian et al. |
| 5,959,266 | A | 9/1999 | Uchiumi |
| 6,089,355 | A | 7/2000 | Seki et al. |
| 6,173,813 | B1 | 1/2001 | Rebillard et al. |
| 6,446,759 | B1 | 9/2002 | Kulak et al. |
| 6,474,448 | B1 | 11/2002 | Zappa |
| 7,147,084 | B2 | 12/2006 | Jahkonen |
| 7,252,179 | B2 | 8/2007 | Oberleitner |
| 7,350,623 | B2 | 4/2008 | Kinoshita et al. |
| 7,398,862 | B2 | 7/2008 | Dziwak |

(Continued)

FOREIGN PATENT DOCUMENTS

| | | | |
|---|---|---|---|
| CN | 201610675 | U | 10/2010 |
| CN | 204057608 | U | 12/2014 |

(Continued)

OTHER PUBLICATIONS

Extended European Search Report for Application No. EP 19 17 2026 dated Sep. 5, 2019.

(Continued)

*Primary Examiner* — Diem M Tran
(74) *Attorney, Agent, or Firm* — Carlson, Gaskey & Olds, P.C.

(57) ABSTRACT

An illustrative example elevator door interlock includes at least one coupling roller supported on a base. A lock is configured to move relative to the base and the at least one coupling roller between a locking position and an unlocked position. An unlocking roller supported on the lock is situated to be moved by a vane of an elevator door coupler to move the lock into the unlocked position prior to the vane contacting the coupling roller. The elevator door interlock is compatible with a clamping type elevator door coupler and an expanding type elevator door coupler. The coupling roller is situated to be received between two vanes of the clamping type elevator door coupler or received against one of two vanes of the expanding type elevator door coupler.

12 Claims, 3 Drawing Sheets

(56) References Cited

U.S. PATENT DOCUMENTS

| | | | |
|---|---|---|---|
| 7,650,971 | B2 | 1/2010 | Pillin et al. |
| 8,939,262 | B2 | 1/2015 | Schienda et al. |
| 9,260,275 | B2 | 2/2016 | Reuter et al. |
| 9,302,886 | B2 | 4/2016 | Tantis et al. |
| 9,637,350 | B2 | 5/2017 | Mittermayr |
| 9,656,835 | B2 | 5/2017 | Kitazawa |
| 9,663,329 | B2 | 5/2017 | Zappa |
| 9,834,413 | B2 | 12/2017 | Mittermayr |
| 9,845,224 | B2 | 12/2017 | Rasanen et al. |
| 10,196,237 | B2 | 2/2019 | Kattainen et al. |
| 11,040,858 | B2 | 6/2021 | Kulak et al. |
| 11,046,557 | B2 | 6/2021 | Tracey et al. |
| 2001/0003319 | A1 | 6/2001 | Itoh et al. |
| 2008/0000727 | A1 | 1/2008 | Dziwak |
| 2012/0000729 | A1 | 1/2012 | Marvin et al. |
| 2012/0000732 | A1 | 1/2012 | Draper et al. |
| 2012/0298453 | A1 | 11/2012 | Fujii et al. |
| 2016/0145074 | A1 | 5/2016 | Kattainen et al. |
| 2017/0190547 | A1 | 7/2017 | Dharmaraj |
| 2018/0079621 | A1 | 3/2018 | Fauconnet et al. |
| 2018/0118514 | A1 | 5/2018 | Bruno |
| 2018/0229972 | A1 | 8/2018 | Kulak et al. |
| 2018/0265334 | A1 | 9/2018 | Kulak et al. |
| 2019/0337765 | A1 | 11/2019 | Wang et al. |
| 2019/0337767 | A1 | 11/2019 | Tracey et al. |
| 2019/0337768 | A1 | 11/2019 | Kulak et al. |
| 2019/0337769 | A1 | 11/2019 | Khzouz et al. |
| 2020/0115192 | A1 | 4/2020 | Montigny et al. |

FOREIGN PATENT DOCUMENTS

| | | | |
|---|---|---|---|
| CN | 204369335 | U | 6/2015 |
| CN | 103693538 | B | 7/2015 |
| CN | 104773637 | A | 7/2015 |
| CN | 103693539 | B | 11/2015 |
| CN | 103803389 | B | 11/2015 |
| CN | 104176604 | B | 3/2016 |
| CN | 104444734 | B | 3/2016 |
| CN | 105645239 | A | 6/2016 |
| CN | 105936467 | A | 9/2016 |
| CN | 106006324 | A | 10/2016 |
| CN | 106044504 | A | 10/2016 |
| CN | 106081819 | A | 11/2016 |
| CN | 106081820 | A | 11/2016 |
| CN | 106395582 | A | 2/2017 |
| CN | 107176530 | A | 9/2017 |
| CN | 107614412 | A | 1/2018 |
| EP | 2426076 | A1 | 3/2012 |
| EP | 3048075 | B1 | 3/2018 |
| EP | 3636578 | A1 | 4/2020 |
| GB | 415931 | | 9/1934 |
| GB | 2358623 | A | 8/2001 |
| JP | H0812228 | | 1/1996 |
| JP | H10203742 | A | 8/1998 |
| JP | 2005008371 | | 1/2013 |
| WO | 2005/077808 | A2 | 8/2005 |
| WO | 2006/080094 | A1 | 8/2006 |
| WO | 2011/104818 | A1 | 9/2011 |
| WO | 2011/137545 | A1 | 11/2011 |
| WO | 2014/122358 | A1 | 8/2014 |
| WO | 2016/085678 | A1 | 6/2016 |
| WO | 2016/176033 | A1 | 11/2016 |
| WO | 2017/023927 | A1 | 2/2017 |
| WO | 2017/187560 | A1 | 11/2017 |

OTHER PUBLICATIONS

Extended European Search Report for Application No. EP 19 17 2040 dated Sep. 23, 2019.

Extended European Search Report for Application No. EP 19 17 2105 dated Sep. 27, 2019.

Extended European Search Report for Application No. EP 19 17 2084 dated Mar. 18, 2020.

Extended European Search Report for Application No. EP 19 17 2106 dated Jan. 31, 2020.

Extended European Search Report for EP 22 20 8903.9 dated May 22, 2023.

VERSATILE ELEVATOR DOOR INTERLOCK ASSEMBLY

BACKGROUND

Elevator systems are in widespread use for carrying passengers between various levels in buildings, for example. Access to an elevator car requires that elevator car doors open when the car is at a landing at which a passenger desires to board the elevator car, for example. Each landing includes hoistway doors that move with the elevator car doors between open and closed positions.

There are various known coupler and interlock arrangements for coupling the elevator car doors to the hoistway doors so that the door mover that causes movement of the car doors also causes desired movement of the hoistway doors. Most door couplers include a set of vanes supported on the elevator car door structure. Most interlocks include at least one roller supported on the hoistway door structure to be engaged by the vanes for moving the hoistway door with the elevator car door.

It is believed that elevator door system components account for approximately 50% of elevator maintenance requests and 30% of callbacks. Almost half of the callbacks due to a door system malfunction are related to one of the interlock functions.

Another drawback associated with known interlock arrangements is that the process of installing the interlocks along the hoistway is time-consuming and undesirably complicated. Each interlock has to be positioned to receive the coupler vanes as the elevator car approaches the corresponding landing. Inaccurate interlock placement may result in undesired contact between the coupler vanes and the interlock as the elevator car passes the landing, for example. Additionally, adjusting the rollers to achieve the necessary alignment with the coupler requires adjusting the position of the corresponding hoistway door lock and switch to ensure that the interlock properly cooperates with the lock. If the lock and switch components are not accurately positioned, the elevator may not perform reliably as indications from the switches along the hoistway are needed to ensure that all hoistway doors are closed before the elevator car moves along the hoistway.

SUMMARY

An illustrative example elevator door interlock includes at least one coupling roller supported on a base. A lock is configured to move relative to the base and the at least one coupling roller between a locking position and an unlocked position. An unlocking roller supported on the lock is situated to be moved by an elevator door coupler component to move the lock into the unlocked position prior to the coupler component contacting the coupling roller. The elevator door interlock is compatible with a clamping type elevator door coupler and an expanding type elevator door coupler. The coupling roller is situated to be received between two vanes of the clamping type elevator door coupler when the interlock is installed in an elevator system including the clamping type elevator door coupler or received against one of two vanes of the expanding type elevator door coupler when the interlock is installed in an elevator system including the expanding type elevator door coupler.

In addition to one or more of the features described above, or as an alternative, the lock includes a bracket, the unlocking roller is supported on the bracket, and the bracket is selectively moveable relative to the lock to adjust a position of the unlocking roller relative to the lock.

In addition to one or more of the features described above, or as an alternative, the bracket includes a slot, the lock comprises at least one fastener at least partially received through the slot, and the at least one fastener selectively secures the bracket in a fixed position relative to the lock.

In addition to one or more of the features described above, or as an alternative, the at least one coupling roller includes a first coupling roller and a second coupling roller, the two vanes of the expanding type elevator door coupler are received between the first coupling roller and the second coupling roller when the interlock is installed in the elevator system having the expanding type elevator door coupler, one of the two vanes of the expanding type elevator door coupler engages the first coupling roller, and another one of the two vanes of the expanding type elevator door coupler engages the second coupling roller.

In addition to one or more of the features described above, or as an alternative, the at least one coupling roller includes a first coupling roller and a second coupling roller, there is a gap between the first coupling roller and the second coupling roller, the unlocking roller is situated relative to the gap such that one of the vanes of the elevator door coupler contacts the unlocking roller and urges the lock into the unlocked position when the one of the vanes is at least partially in the gap, and the unlocking roller is situated relative to the gap when the lock is in the unlocked position so that the lock does not carry any load associated with movement of an associated hoistway door.

In addition to one or more of the features described above, or as an alternative, a first distance separates the unlocking roller from the second coupling roller when the lock is in the locking position; a second distance separates the unlocking roller from the first coupling roller when the lock is in the unlocked position; the first distance is smaller than the second distance; and the second distance is at least as large as the gap.

In addition to one or more of the features described above, or as an alternative, the at least one coupling roller is rotatable about a central axis.

In addition to one or more of the features described above, or as an alternative, the unlocking roller is rotatable about a central axis.

In addition to one or more of the features described above, or as an alternative, the elevator door interlock of any preceding paragraph includes a latch, a switch, and a switch contact supported on the lock that cooperates with the switch to indicate when the lock is in the locking position. The base is selectively movable relative to the latch and the switch, and the latch and the switch remain in a fixed position relative to the pivot axis when the base is selectively moved.

In addition to one or more of the features described above, or as an alternative, the elevator door interlock of any preceding paragraph includes a switch and a stop, the lock includes a slot, the slot defines a locking surface, and the locking surface engages the stop when the lock is in the locking position.

In addition to one or more of the features described above, or as an alternative, the stop comprises a plate that is received at least partially into the slot when the lock is in the locking position.

An illustrative example embodiment of an elevator door assembly includes the elevator door interlock of any preceding paragraph, an elevator car door that is moveable between an open position and a closed position, and a hoistway door that is moveable between an open position and a closed position. The base and the lock are associated with the hoistway door for movement with the hoistway door, and one of the clamping type elevator door coupler or the expanding type elevator door coupler is supported on the elevator car door for movement with the elevator car door.

The various features and advantages of an example embodiment will become apparent to those skilled in the art from the following detailed description. The drawings that accompany the detailed description can be briefly described as follows.

DETAILED DESCRIPTION

Embodiments of this invention provide an elevator door interlock that is versatile and compatible with more than one type of elevator door coupler. A single configuration of the interlock is compatible with couplers having expanding or clamping vanes. Additionally, the interlock is easily adjustable for properly aligning the interlock with the elevator door coupler. The alignment can be achieved without requiring any adjustment of relative positions of the lock and lock switch components. Embodiments of this invention also separate the door unlocking and door moving functions. In previous interlocks, a roller used to unlock the door lock also carried a significant portion of the load associated with opening the hoistway door. By separating the unlocking and door moving functions, the lock of the interlock and its supporting components do not need to bear the load associated with opening the hoistway door.

Figure 1:
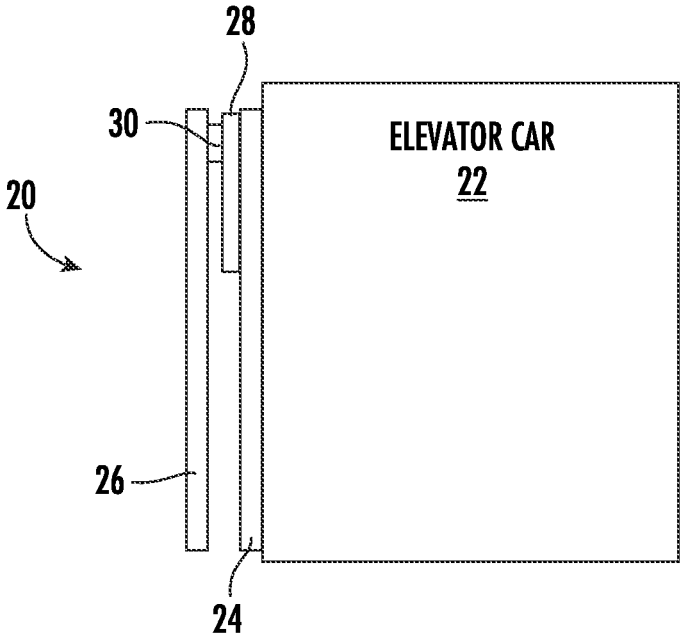
FIG. 1 schematically illustrates selected portions of an elevator system including a door interlock designed according to an embodiment of this invention.

FIG. 1 schematically illustrates selected portions of an elevator system 20. An elevator car 22 includes car doors 24 that are situated adjacent hoistway landing doors 26 when the elevator car 22 is parked at a landing. At least one portion or component of a door coupler 28 associated with the elevator car doors 24 cooperates with an interlock 30 associated with the hoistway doors 26 so that the elevator car doors 24 and the hoistway doors 26 move together between opened and closed positions.

Figure 2:
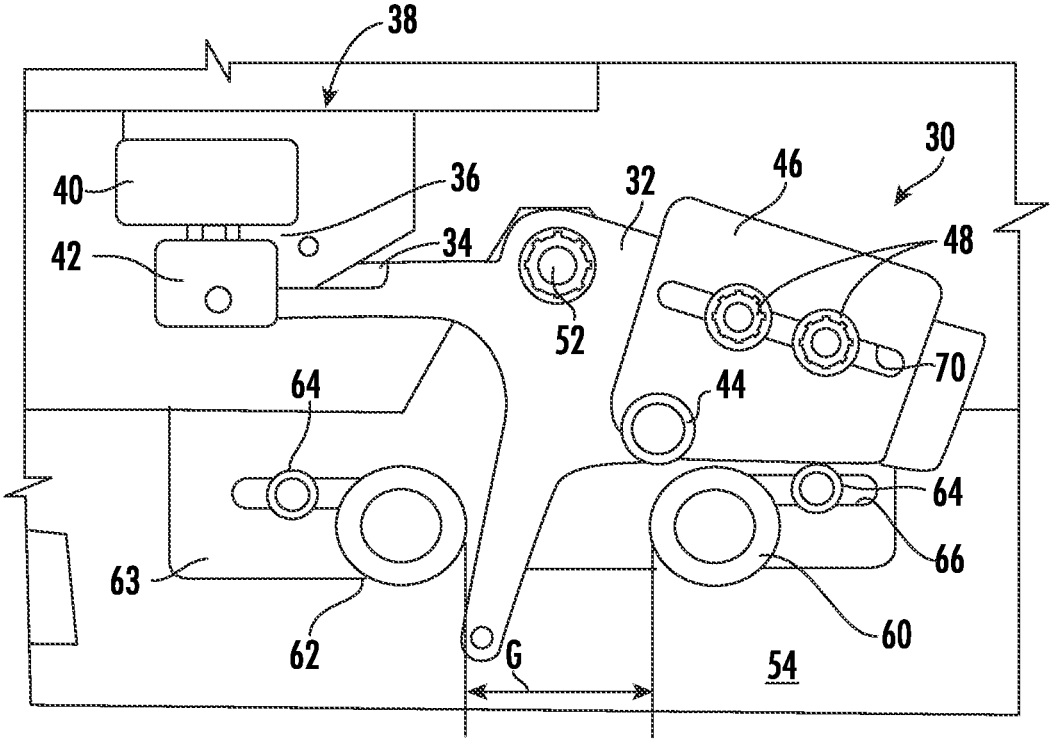
FIG. 2 schematically shows an example elevator door interlock designed according to an embodiment of this invention with a lock in a locking position.
Figure 3:
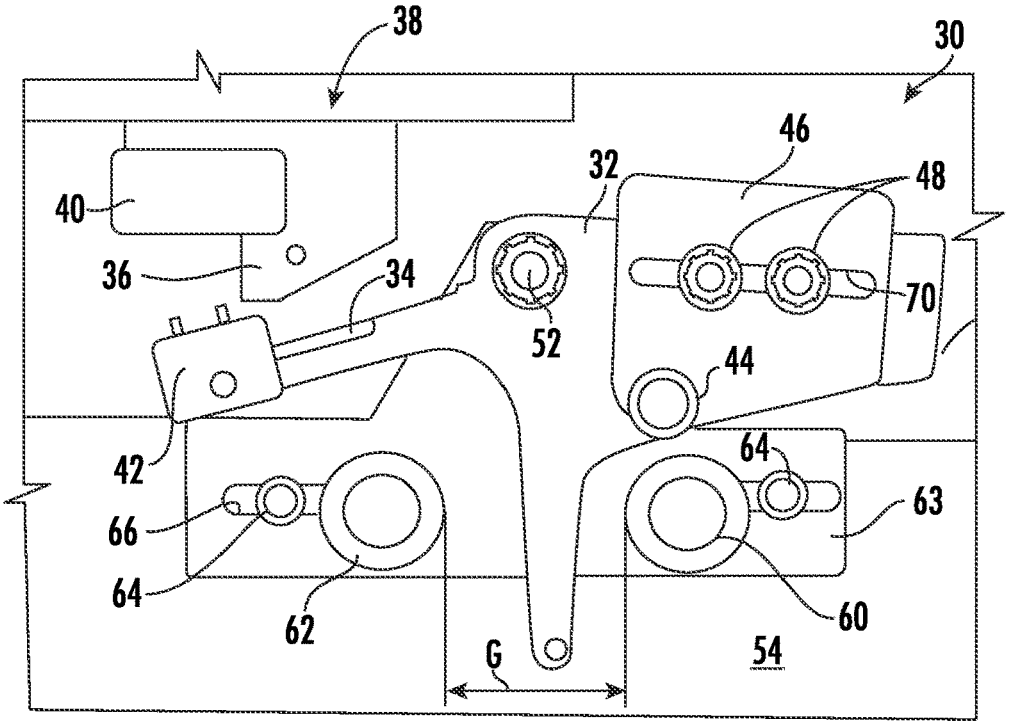
FIG. 3 shows the example interlock of FIG. 2 with the lock in an unlocked position.

FIGS. 2 and 3 show the interlock 30 of an example embodiment. The interlock 30 includes a lock 32 that is moveable between a locking position (shown in FIG. 2) and an unlocked position (shown in FIG. 3). A locking surface at one end of a slot 34 on the lock 32 engages a stop 36 on a door latch 38 when the lock 32 is in the locking position. In the unlocked position shown in FIG. 3, the locking surface of the slot 34 is clear of the stop 36 and the door 26 (FIG. 1) is free to move with the elevator car door 24.

The latch 38 includes a switch 40. A switch contact 42 supported on the lock 32 cooperates with the switch 40 to provide an indication when the lock 32 is in the locking position. The switch 40 works in a known manner to provide an indication when a corresponding hoistway door 26 is unlocked based on a lack of contact between the switch 40 and the switch contact 42 as shown, for example, in FIG. 3.

An unlocking roller 44 is supported on a bracket 46 that is secured to the lock 32. In this example, at least one fastener 48 secures the bracket 46 in a selected position relative to the lock 32. One aspect of the bracket 46 is that the mass of the bracket serves as a weight to bias the lock 32 into the locking position.

In the illustrated embodiment, the unlocking roller 44 comprises a roller or sleeve supported on the bracket 46. In one example embodiment, the bracket 46 includes a post or boss with a low-friction material sleeve received around the post. The unlocking roller 44 in most embodiments is rotatable about a center axis to accommodate relative vertical movement between a portion of the door coupler 28 and the unlocking roller 44. In some embodiments, the roller 44 does not rotate but can still be referred to as a roller, a skate, or a slide.

The interlock 30 is compatible with more than one type of elevator door coupler 28. For example, the interlock 30 works with an expanding type of elevator door coupler that has vanes that move apart or expand to engage the interlock 30 for coordinated movement of the elevator car door 24 and the hoistway door 26. The interlock 30 also works with a clamping type elevator car door coupler that has vanes that move closer together to engage the interlock 30.

Figure 4A:
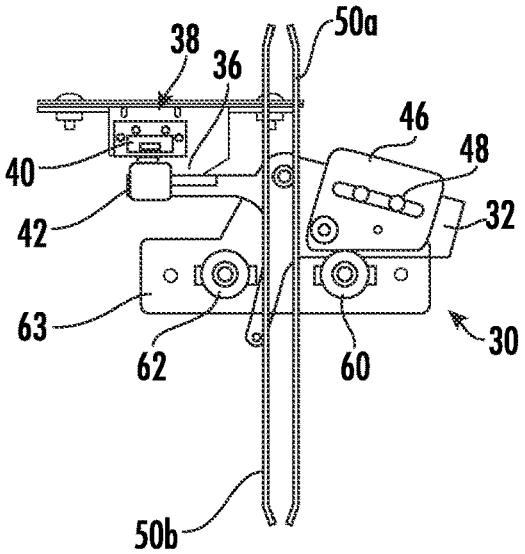
FIG. 4A shows selected portions of an assembly including coupler vanes and the example interlock in a locking position.
Figure 4B:
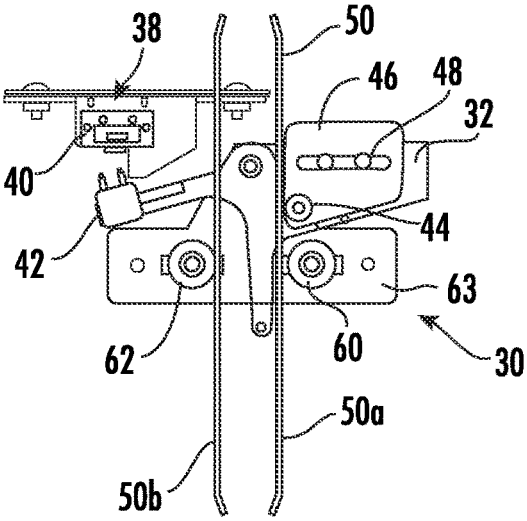
FIG. 4B shows the embodiment of FIG. 4A with the example interlock in an unlocked position.

FIGS. 4A and 4B schematically illustrate door coupler components 50*a* and 50*b*, such as vanes, of an expanding type coupler. In FIG. 4A, the door coupler components or vanes 50*a* and 50*b* are in a contracted position that allows the elevator car 22 to move vertically relative to the hoistway door 26 without any interaction between the coupler 28 and the interlock 30. When the elevator car 22 is at the landing including the hoistway door 26 and it is necessary or desirable to open the doors, the vanes 50*a* and 50*b* move away from each other or expand into the position shown in FIG. 4B.

As the vanes move into the expanded position, the vane 50*a* contacts the unlocking roller 44 and urges it in a direction (to the right according to the drawings) that moves the lock 32 into the unlocked position of FIGS. 3 and 4B. The lock 32 is supported to pivot about a pivot axis 52 relative to a door component 54, such as a door hanger, as the unlocking roller 44 moves responsive to the force of the vane 50*a*.

Once the lock 32 is in the unlocked position, the door coupler 28 including the door coupler components 50*a*, 50*b* can move the hoistway door 26 with the elevator car door 24. The illustrated example interlock 30 includes coupling rollers 60 and 62 that are received against the vanes 50*a* and 50*b*, respectively. The coupling roller 60 bears the load of opening the door 26 and the coupling roller 62 bears the load associated with closing the door 26. The coupling rollers 60 and 62 carry all of the load associated with moving the hoistway door 26 with the elevator car door 24. The unlocking roller 44 and lock 32 do not carry any of the load associated with moving the hoistway door 26. By separating the door unlocking and door movement functions, the illustrated example reduces the load and wear on the components associated with the lock 32 that otherwise bear the load associated with moving the hoistway door 26 in previous interlock designs.

In the example embodiment, the coupling rollers 60 and 62 comprise rollers supported on at least one base 63. The coupling rollers 60 and 62 rotate about a respective central axis in many embodiments. In some embodiments, the coupling rollers 60 and 62 do not rotate but can still be referred to as rollers, skates or slides.

One feature of the example interlock 30 is that the positions of the coupling rollers 60 and 62 relative to the door component 54 may be adjusted by selectively moving the base 63 relative to the door component 54. In the illustrated example, a plurality of fasteners 64 are at least partially received through slots 66 on the base 63. When the fasteners 64 are appropriately loosened, the base 63 may be moved linearly and horizontally (i.e., right or left according to the drawings) for purposes of changing a position of the coupling rollers 60 and 62 relative to the pivot axis 52 of the lock 32. Moving the base 63 and the coupling rollers 60 and 62 in this manner allows for aligning the rollers 60 and 62 with the door coupler 28 without having to move or adjust the pivot axis 52 of the lock 32. One of the features of the illustrated example embodiment is that it allows for adjusting the alignment position of the coupling rollers 60 and 62 without having to change any of the positions of the lock 32, the pivot axis 52, the switch 40 or the latch 38. This reduces the amount of alignment and adjustment required when attempting to align interlocks at a plurality of landings with the door coupler 28 on the elevator car 22.

In one example embodiment, the coupling rollers 60 and 62 are set in fixed positions on the base 63. In another example embodiment, at least one of the coupling rollers 60 is adjustable into more than one position relative to the base 63. For example, an eccentric adjustment feature allows for changing the position of the axis of at least one of the coupling roller rollers 60 and 62 relative to the base 63 to change a size of a gap G between the rollers 60 and 62. The fasteners 64 selectively secure the base 63 and the coupling rollers 60 and 62 in a fixed position relative to the door component 54 to maintain the desired alignment between the door coupler 28 and the coupling rollers 60 and 62.

The unlocking roller 44 is situated within the gap G between the coupling rollers 60 and 62 when the lock 32 is in the locking position shown in FIGS. 2 and 4A. The unlocking roller 44 is situated within the gap G so that it contacts a door coupler component, such as the vane 50*a* prior to that same component contacting the coupling roller 60. As the coupler component 50*a* moves to the right (according to the drawings), that urges the unlocking roller 44 to the right causing the lock 32 to move from the locking position into the unlocked position.

In the locking position, the unlocking roller 44 is spaced laterally from the coupling roller 62 by a first distance as can be appreciated from FIGS. 2 and 4A. When the lock 32 moves into the unlocked position, the unlocking roller 44 moves into a position that is spaced a second, larger distance from the coupling roller 62 as can be appreciated from FIGS. 3 and 4B. The second distance corresponds to at least the size of the gap G as can be appreciated from FIG. 3. With the unlocking roller 44 in this position, a door coupler component 50*a* contacts the coupling roller 60 and the load associated with moving the hoistway door 26 is transferred to the door component 54 through the coupling roller 60 and base 63 without requiring the unlocking roller 44 or the lock 32 and its associated components to carry any of the load associated with moving the door 26.

The bracket 46 includes a slot 70 that allows for adjusting a position of the unlocking roller 44 relative to the coupling rollers 60 and 62 to achieve the desired amount of movement of the lock 32 into the unlocked position based on contact between the door coupler component 50*a* and the unlocking roller 44. The adjustment of the bracket 46 also ensures that the unlocking roller 44 is situated where it will not carry the load associated with moving the door 26 while the lock 32 is in the unlocked position.

In the illustrated example embodiment, translational or horizontal adjustment along the length of the slot 70 allows for changing the position of the unlocking roller 44 relative to the coupling rollers 60 and 62 for selecting the appropriate position of the unlocking roller 44 to achieve appropriate interlock operation.

Having the ability to adjust the position of the unlocking roller 44 and coupling rollers 60 and 62 without having to move any of the lock 32, pivot axis 52 or switch 40 allows for aligning interlocks 30 along an entire hoistway with the door coupler 28 of the elevator car 22 in a more efficient and economical manner. There is no need to adjust the lock 32 or switch contact 42 relative to the latch 38, for example. The relative positions of the pivot axis 52, latch 38, switch 40, and switch contact 42 do not change during adjustment of the roller positions so there is no risk of a misalignment between the switch 40 and switch contact 42. This feature of the illustrated example enhances the reliability of proper operation of the elevator system and reduces the amount of labor required to achieve proper alignment between the door coupler 28 and the interlocks 30 along the hoistway.

Additionally, the illustrated example embodiment allows for the position of the pivot axis 52, the latch 38, the switch 40, and the switch contact 42 to all be pre-established in a controlled manufacturing setting. The interlock 30 may be installed as a preassembled unit onto a door component 54, such as a door hanger, which further reduces labor, time and cost at the site of the elevator system and further enhances the accuracy of the relative positions of the components of the interlock 30. This type of arrangement leads to a more reliable interlock system and elevator system operation.

Figure 5A:
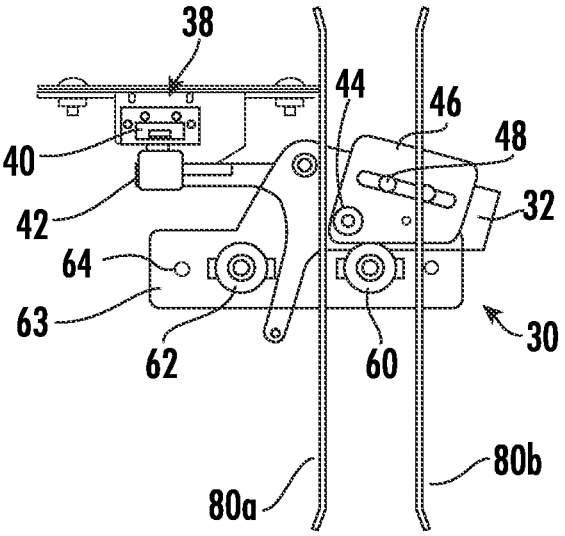
FIG. 5A schematically shows selected portions of an assembly including coupler vanes and the example interlock in a locking position.
Figure 5B:
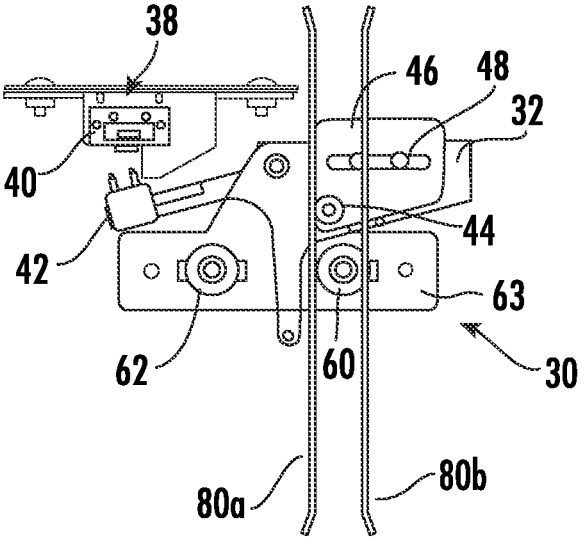
FIG. 5B shows the embodiment of FIG. 5A with the example interlock in an unlocked position.

FIGS. 5A and 5B schematically show operation of the interlock 30 when it is installed in elevator system that includes a clamping type elevator door coupler 28. In this embodiment, the coupling roller 60 is received between door coupler components 80*a* and 80*b*, which are vanes in this example. The vanes 80*a* and 80*b* are spaced apart as shown in FIG. 5A to allow the elevator car 22 to move vertically relative to the hoistway door 26 without any interaction between the coupler components 80*a*, 80*b* and the interlock 30.

When the elevator car 22 is at the landing that includes the hoistway door 26 and it is desired or necessary to open the doors, the vanes 80*a* and 80*b* move toward each other in a manner that results in clamping the coupling roller 60 between the vanes 80*a*, 80*b* as shown in FIG. 5B. As the vane 80*a* moves from the position shown in FIG. 5A to the position shown in FIG. 5B, the vane 80*a* contacts the unlocking roller 44 and moves it so the lock 32 moves from the locking position of FIGS. 2 and 5A into the unlocked position of FIGS. 3 and 5B.

Once the vane 80*a* contacts the coupling roller 60, the doors 24 and 26 can move together as the vane 80*a* bears against the coupling roller 60 to open the doors (i.e., move to the right according to the drawing). To move the doors in the opposite direction, the vane 80*b* bears against the coupling roller 60. The unlocking roller 44 and the lock 32 are isolated from the loads associated with moving the hoistway door 26.

As can be appreciated from FIGS. 5A and 5B, the coupling roller 62 is not engaged by the door coupler components 80*a* or 80*b*. The roller 62 may be removed or left in place to have a spare part on hand in the event the roller 60 would need to be replaced.

The versatility of the illustrated example embodiment of the interlock 30 allows it to be used with either type of elevator door coupler mentioned above. The disclosed interlock 30 is compatible with a variety of expanding and clamping type elevator door couplers. At least one of the coupling rollers 60, 62 is received between the vanes 80*a*, 80*b* when the interlock 30 is installed in an elevator system that includes a clamping type coupler. At least one of the coupling rollers 60, 62 is received against at least one of the vanes 50*a*, 50*b* when the interlock is installed in an elevator system that includes an expanding type coupler. In either case, the unlocking roller 44 is moved by a component of the elevator door coupler 28 to unlock the lock 32 without requiring the unlocking roller 44 or any of the lock components to bear the loads associated with moving the hoistway door 26.

Interlocks designed according to an embodiment of this invention reduce costs in multiple ways. The versatility of the interlock, which makes it compatible with multiple types of elevator door couplers, reduces inventory requirements and facilitates a universal installation procedure for most, if not all, elevator systems. The interlock features also facilitate reducing callbacks that are otherwise associated with problems or malfunctions caused by interlock misalignment or wear and tear on the lock and associated components of an interlock. Embodiments of this invention provide cost savings not only during installation or maintenance procedures, but also by reducing the need for maintenance or adjustment during the service life of the associated elevator system.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

I claim:

1. An elevator door interlock, comprising:

a base;

at least one coupling roller supported on the base;

a lock configured to move relative to the base and the at least one coupling roller between a locking position and an unlocked position; and an unlocking roller supported on the lock and situated to be moved by a vane of an elevator door coupler to move the lock into the unlocked position prior to the at least one coupling roller being contacted by the vane, wherein the elevator door interlock is configured to operate with a clamping type elevator door coupler having at least one clamping vane that moves closer to another clamping vane to clamp the at least one coupling roller between the clamping vanes and an expanding type elevator door coupler having at least one expanding vane that moves further away from another expanding vane to engage the at least one coupling roller against an outside of at least one of the expanding vanes, the at least one coupling roller is situated to be received between two vanes of the clamping type elevator door coupler when the elevator door interlock is installed in an elevator system having the clamping type elevator door coupler, and the at least one coupling roller is situated to be received against one of two vanes of the expanding type elevator door coupler when the elevator door interlock is installed in an elevator system having the expanding type elevator door coupler.

2. The elevator door interlock of claim 1, wherein the lock includes a bracket, the unlocking roller is supported on the bracket, and the bracket is selectively moveable relative to the lock to adjust a position of the unlocking roller relative to the lock.

3. The elevator door interlock of claim 2, wherein the bracket includes a slot, the lock comprises at least one fastener at least partially received through the slot, and the at least one fastener selectively secures the bracket in a fixed position relative to the lock.

4. The elevator door interlock of claim 1, wherein the at least one coupling roller includes a first coupling roller and a second coupling roller, the two vanes of the expanding type elevator door coupler are received between the first coupling roller and the second coupling roller when the interlock is installed in the elevator system having the expanding type elevator door coupler, one of the two vanes of the expanding type elevator door coupler engages the first coupling roller, and another one of the two vanes of the expanding type elevator door coupler engages the second coupling roller.

5. The elevator door interlock of claim 1, wherein the at least one coupling roller includes a first coupling roller and a second coupling roller, there is a gap between the first coupling roller and the second coupling roller, the unlocking roller is situated relative to the gap such that one of the vanes of the elevator door coupler contacts the unlocking roller and urges the lock into the unlocked position when the one of the vanes is at least partially in the gap, and the unlocking roller is situated relative to the gap when the lock is in the unlocked position so that the lock does not carry any load associated with movement of an associated hoistway door.

6. The elevator door interlock of claim 5, wherein a first distance separates the unlocking roller from the second coupling roller when the lock is in the locking position;

a second distance separates the unlocking roller from the first coupling roller when the lock is in the unlocked position;

the first distance is smaller than the second distance; and the second distance is at least as large as the gap.

7. The elevator door interlock of claim 1, wherein the at least one coupling roller is rotatable about a central axis.

8. The elevator door interlock of claim 1, wherein the unlocking roller is rotatable about a central axis.

9. The elevator door interlock of claim 1, comprising a latch including a switch; and a switch contact supported on the lock that cooperates with the switch to indicate when the lock is in the locking position; and wherein the base is selectively movable relative to the latch and the switch; and the latch and the switch remain in a fixed position relative to the pivot axis when the base is selectively moved.

10. The elevator door interlock of claim 1, comprising a switch and a stop and wherein the lock includes a slot, the slot defines a locking surface, and the locking surface engages the stop when the lock is in the locking position.

11. The elevator door interlock of claim 10, wherein the stop comprises a plate that is received at least partially into the slot when the lock is in the locking position.

12. An elevator door assembly, comprising the elevator door interlock of claim 1;

an elevator car door that is moveable between an open position and a closed position; and a hoistway door that is moveable between an open position and a closed position, wherein the base and the lock are associated with the hoistway door for movement with the hoistway door, and one of the clamping type elevator door coupler or the expanding type elevator door coupler is supported on the elevator car door for movement with the elevator car door.

* * * * *